US007782200B1

(12) United States Patent
Fleischmann

(10) Patent No.: US 7,782,200 B1
(45) Date of Patent: Aug. 24, 2010

(54) REUSABLE ELECTRONIC TRAILER SEAL

(76) Inventor: Arthur R. Fleischmann, 15850 Alicante Rd., Apt. #17, La Marada, CA (US) 90638

( * ) Notice: Subject to any disclaimer, the term of this patent is extended or adjusted under 35 U.S.C. 154(b) by 425 days.

(21) Appl. No.: 11/977,452

(22) Filed: Oct. 25, 2007

Related U.S. Application Data

(60) Provisional application No. 60/856,327, filed on Nov. 3, 2006.

(51) Int. Cl.
*E05B 45/06* (2006.01)
*E05B 17/00* (2006.01)
*E05B 39/04* (2006.01)

(52) U.S. Cl. ..... 340/542; 340/543; 70/330; 70/434; 70/437

(58) Field of Classification Search ..... 340/542, 340/543; 70/431–437, 330–332
See application file for complete search history.

(56) References Cited

U.S. PATENT DOCUMENTS

| | | | | |
|---|---|---|---|---|
| 1,367,647 | A | 2/1921 | Washburn | |
| 3,572,063 | A | 3/1971 | Foote | |
| 3,863,468 | A | 2/1975 | Bach | |
| 4,287,512 | A * | 9/1981 | Combs | 340/542 |
| 4,555,920 | A | 12/1985 | Stanich | |
| 4,766,419 | A * | 8/1988 | Hayward | 340/545.2 |
| 4,994,800 | A * | 2/1991 | Milliken | 340/901 |
| 5,153,561 | A * | 10/1992 | Johnson | 340/571 |
| 5,543,665 | A | 8/1996 | Demarco | |
| 6,058,745 | A | 5/2000 | Sanchez | |
| D426,763 | S | 6/2000 | Adler et al. | |
| 6,420,971 | B1 * | 7/2002 | Leck et al. | 340/542 |
| 6,442,983 | B1 * | 9/2002 | Thomas et al. | 70/38 A |
| 6,527,312 | B1 | 3/2003 | Jackovinov et al. | |
| 6,803,674 | B2 * | 10/2004 | Crisp | 307/10.2 |
| 7,044,512 | B1 | 5/2006 | Moreno | |
| 7,063,362 | B1 | 6/2006 | Liroff | |
| 2006/0111793 | A1 * | 5/2006 | Stokes et al. | 700/3 |

* cited by examiner

*Primary Examiner*—Jennifer Mehmood
(74) *Attorney, Agent, or Firm*—Gordon K. Anderson

(57) ABSTRACT

A reusable electronic seal for a trailer includes a structural enclosure configured to attach onto a shackle of a padlock with an electronic module integrated within the to enclosure. A rechargeable battery circuit with a photovoltaic cell is in communication with a battery permitting the battery to be charged by the photovoltaic cell when the voltage is low. The electronic module incorporates a microprocessor, a random number generator and a liquid crystal display which communicates with the random number generator. A shackle engagement switch is configured to engage the padlock shackle, applying a signal to the microprocessor when the padlock has been opened. When the padlock is re-latched the shackle engagement switch triggers the microprocessor to signal the random number generator to transmit a new number to the liquid crystal display.

16 Claims, 4 Drawing Sheets

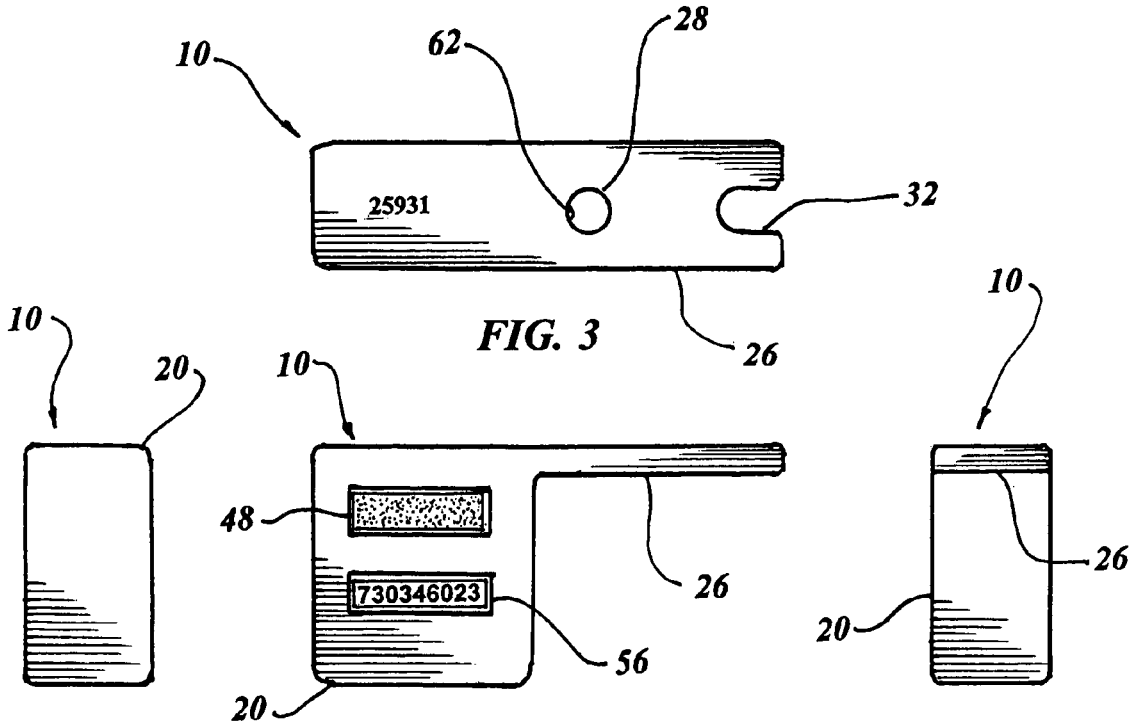
FIG. 3
FIG. 4
FIG. 5
FIG. 6
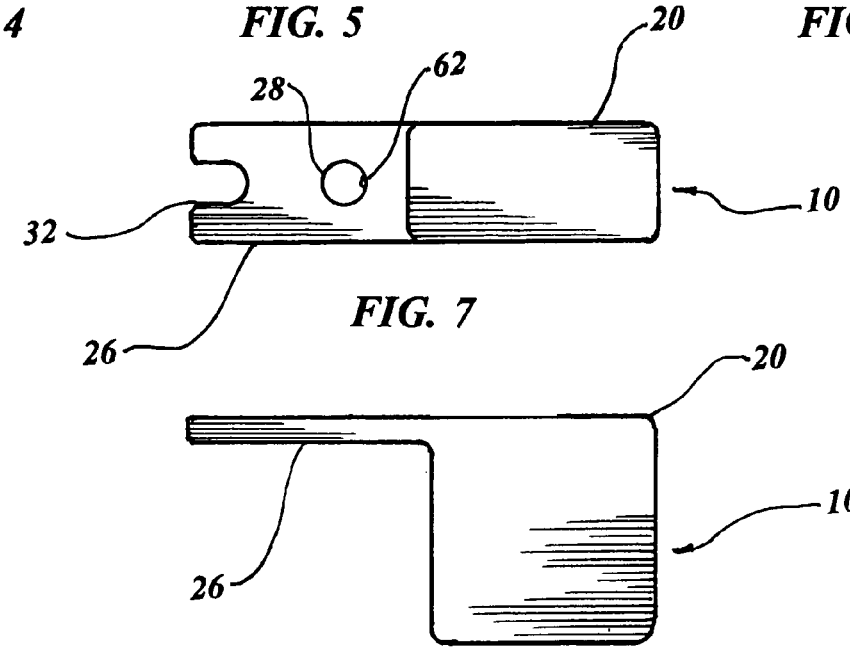
FIG. 7
FIG. 8

REUSABLE ELECTRONIC TRAILER SEAL

CROSS REFERENCE TO RELATED APPLICATION

This application claims priority of Provisional Patent Application Ser. No. 60/856,327 filed Nov. 3, 2006.

TECHNICAL FIELD

The present invention relates to trailer or container seals in general. More specifically to a reusable electronic numeric seal that attaches to a padlock and displays a random number for load identification and replaces the number when the lock is opened and re-latched.

BACKGROUND OF THE INVENTION

Previously, many types of padlocks and security devices have been used in endeavoring to provide an effective means to indicate that the padlock had not been tampered with or the security breached.

A search of the prior art did not disclose any patents that possess the novelty of the instant invention; however the following U.S. patents are considered related:

| U.S. Pat. No. | Inventor | Issue Date |
|---|---|---|
| 1,367,647 | Washburn | Feb. 8, 1921 |
| 3,572,063 | Foote | Mar. 23,1971 |
| 3,863,468 | Bach | Feb. 4, 1975 |
| 4,555,920 | Stanich | Dec. 3, 1985 |
| 5,543,665 | Demarco | Aug. 6, 1996 |
| 6,058,745 | Sanchez | May 9, 2000 |
| Des.426,763 | Adler et al. | Jun. 20, 2000 |
| 6,527,312 B1 | Jackovino et al. | Mar. 4, 2003 |
| 7,044,512 B1 | Moreno | May 16, 2006 |
| 7,063,362 B1 | Liroff | Jun. 20, 2006 |

U.S. Pat. No. 3,572,063 issued to Foote is for a tamper-proof seal retaining lock formed on one wall with a channel plate having an opening registering with the lock keyway. The channel plate holds over the keyway and a portion of a sealing element. As to long as the sealing element remains intact and in position it is impossible to gain access to the lock keyway.

Bach in U.S. Pat. No. 3,863,468 discloses a security casing for a padlock having a bottom, two side walls and two end walls conforming to the body of the padlock. A pair of flexible tongues protect the lock at the end walls with each having a hole for receiving a padlock shackle. A mark on one of the walls identifies each casing.

Stanich in U.S. Pat. No. 4,555,920 teaches a padlock cover molded in one rigid piece and open at the back. The cover has a cylindrical inner wall for holding the body of a padlock. At the top of one side of the inner wall and the outer side wall have a vertically aligned opening for passing one leg of the padlock shackle. At the top of the opposite side of the inner wall and the outer wall each have a vertically aligned slot which are open at the back for passing the opposite leg of the padlock shackle.

U.S. Pat. No. 5,543,665 issued to Demarco is for an electrical switch which includes a key for its operation. The key includes a code which is specific to a specific switch. The switch includes illumination for the key code, also a scanning device for reading the key code, electronic circuits for comparing the key code with the proper key code for that specific lock, and responding to a correct key by allowing the switch to close electrically. If an incorrect key is used the switch prevents the lock from closing electrically and turns on an alarm.

Sanchez in U.S. Pat. No. 6,058,745 discloses a padlock cover assembly for use in latching and locking doors which includes a cover with a peripheral wall. The cover is pivotally mounted to a pivot base which is pivotally mounted to a door member. As the cover is pivoted to advance the padlock to the closed condition the pawl extends interlocking with the shackle of the padlock. An access opening is formed in the peripheral wall of the cover to provide access to a keyhole in the padlock.

U.S. Pat. No. 7,044,512 B1 of Moreno is for a single-use security bar having an elongated bar, a support assembly and a receiving bracket. The seal has matching identification codes on all individual parts and electrical means for determining severance of the bar.

Jackovino et al. in U.S. Pat. No. 6,527,312 B1 teaches a seal for a container. The seal is banana shaped and is inserted over a container handle to make it impossible to move the handle without breaking the seal.

U.S. Pat. No. 7,063,362 B1 of Liroff discloses a cargo seal assembly for maintaining doors on a cargo container. The seal is comprised of an elongated flexible segment which surrounds the lock rods and latch. A lock body is attached to the flexible material segment from its operative position. As such unauthorized access to the interior of the container can only be accomplished by destructive separation of the invention.

For background purposes and as indicative of the art to which the invention is related reference may be made to the remaining cited design U.S. Pat. No. Des.426,763 issued to Adler et al.

BRIEF SUMMARY OF THE INVENTION

In the field of transportation of goods and commodities, it is common for trucking companies use a security seal on the latch of the doors of the truck or trailer to insure that the doors have not been opened from the time of shipment until final delivery. If the seal has been broken or disabled it is an indication that the loads within have been in some way tampered with or pilfered. The seals normally contain the company name and an identification number that is recorded on the bill of lading such that the seal cannot be broken and security defeated by replacing the seal, as the seals contain individualized numbers, usually nine digits. The seals are typically plastic or metal bands; however cables, bolt seals, plastic pull type bands, bar seals etc, attached in the basic area of the door locks are also in common use. A separate padlock is normally employed, usually provided by the driver, which imparts protection from theft when the truck or trailer is left unattended. The seals may be quite expensive, which could be as much as $7.00 each, and are used only for a single load, therefore the cost to the trucking companies may run into a considerable amount of money per year when each seal must be replaced on every new load regardless of the distance to be traveled.

It is therefore a primary object of the invention to utilize a security seal that is reusable and is not necessary to be replaced. The invention is attached directly to the drivers padlock when the padlock is locked into the latch of the trailer. When the lock is snapped closed a new random number is displayed which may be recorded on the bill of lading. As the security seal is electronic it displays the same nine digit number continuously until the padlock is removed. When a new load is hauled the security seal is added to the next drivers padlock and a new number is displayed, which is selected at random by the integral electronics.

An important object of the invention is that a rechargeable battery is used in conjunction with a solar cell which is programmed by a microprocessor to automatically charge the battery when the voltage is below a predetermined level. Since the battery is maintained by solar radiation and the security seal is mounted on the outside of the truck or trailer the system has an almost indefinite life span. The entire electronic module may therefore be completely sealed in plastic resin which is impervious to the elements and has the structural integrity to withstand the over the road environment.

Another object of the invention is that the security seal contains a serial number permanently marked in a conspicuous location which permits the trucking company to also mark the serial number on the bill of lading to maintain identity of its location and its preceding use if stolen or lost.

Still another object of the invention is directed to the cost savings to the trucking companies as the initial cost may be amortized over the seals entire life which is far less than individual seals that are used only once and discarded.

Yet another object of the invention is that the entire manufacturing processes and individual components are well known in the art and readily available therefore no new procedures are required allowing the total price of each seal to be well within the reach of even the smallest trucking company.

A final object of the invention is its adaptability to not only trailers but the security seal may be used with trucks and containers or any other enclosure that is shipped or stored that uses a padlock to protect from unauthorized entry.

These and other objects and advantages of the present invention will become apparent from the subsequent detailed description of the preferred embodiment and the appended claims taken in conjunction with the accompanying drawings.

BRIEF DESCRIPTION OF THE SEVERAL VIEWS OF THE DRAWINGS

FIG. 3 is a top elevation view of trailer seal in the preferred embodiment.

FIG. 4 is a left side elevation view of trailer seal in the preferred embodiment.

FIG. 5 is a front elevation view of trailer seal in the preferred embodiment.

FIG. 6 is a right elevation view of trailer seal in the preferred embodiment.

FIG. 7 is a bottom elevation view of trailer seal in the preferred embodiment.

FIG. 8 is a back elevation view of trailer seal in the preferred embodiment.

DETAILED DESCRIPTION OF THE INVENTION

Figure 1:
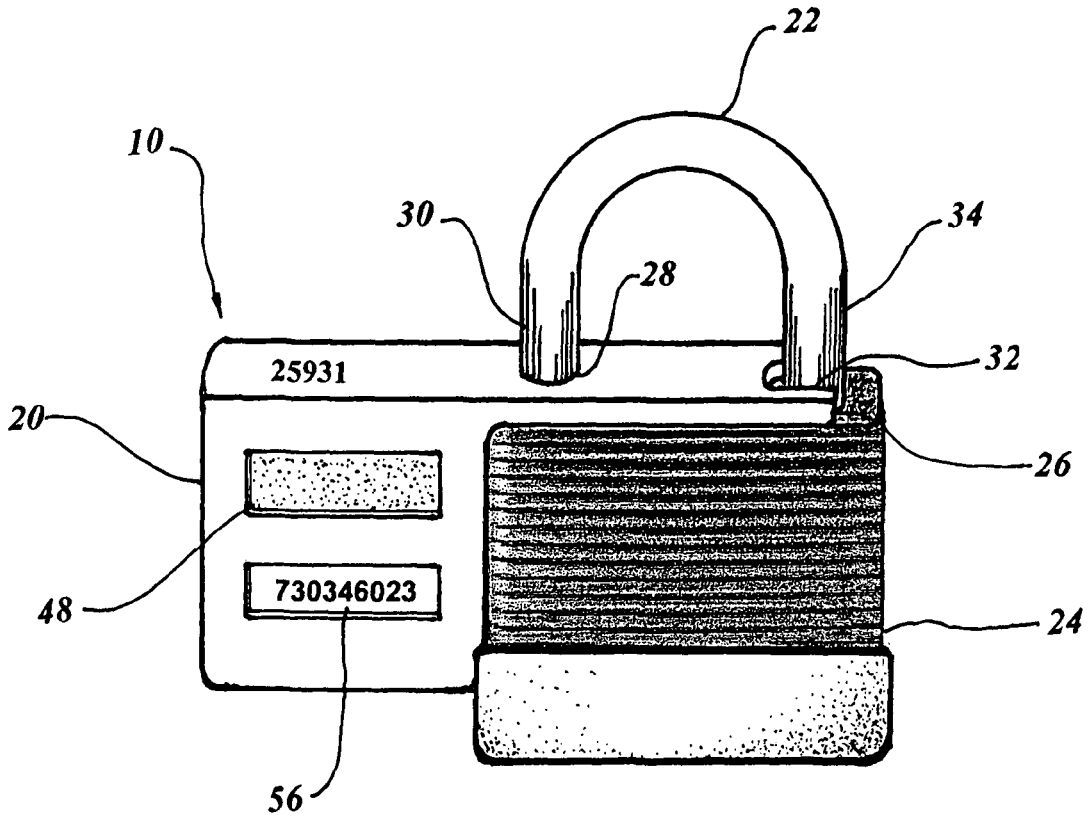
FIG. 1 is a partial isometric view of the trailer seal in the preferred embodiment illustrated attached to a padlock.
Figure 2:
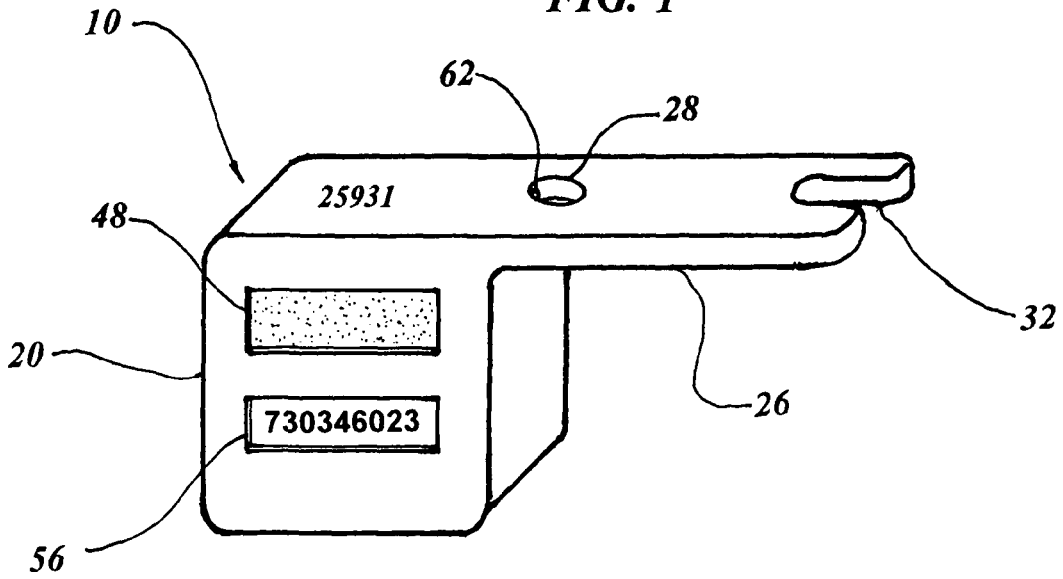
FIG. 2 is a partial isometric view of the trailer seal in the preferred embodiment illustrated separated from a padlock as the padlock is not part of the invention.

The best mode for carrying out the invention is presented in terms of a preferred embodiment of the trailer seal 10. This preferred embodiment of the trailer seal 10 is shown in FIGS. 1 thorough 16 and is comprised of a structural enclosure 20 configured to attach onto the shackle 22 of a padlock 24, as illustrated in FIG. 1. While a laminated padlock 24 is depicted in the drawing, any type of padlock may be used, such as a conventional general purpose steel padlock, a brass padlock, a rotary combination padlock, a tumbler combination padlock, a push button combination padlock or the like.

The structural enclosure 20 is basically rectangular in shape with an outwardly extending arm 26 that permits the seal 10 to interface with the padlock 24, as shown in FIG. 1. The outwardly extending arm 26 is basically flat and essentially the width of a conventional padlock 24, and includes a shackle aperture 28 that continues completely through the arm 26, as illustrated in FIGS. 3 and 7. The aperture 28 is configured to receive the pivotal leg 30 of the padlock shackle 22 and is used to lock the seal 10 onto the padlock 24 through the shackle 22. The aperture 28 is sized sufficiently large and specifically oriented to receive most conventional padlocks that are presently in use with a truck or trailer.

Figure 15:
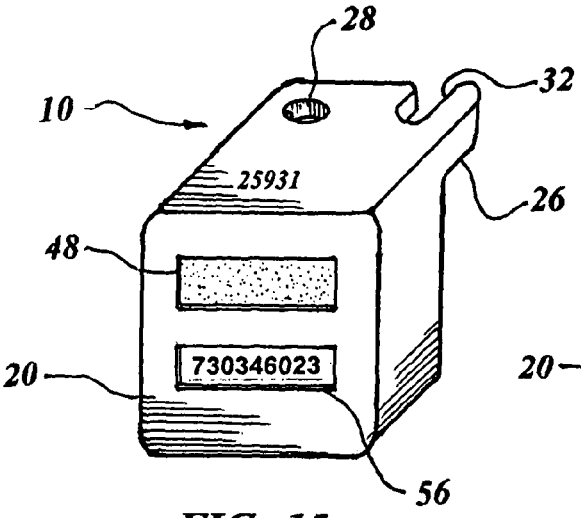
FIG. 15 is a partial isometric view of a first alternate embodiment of the enclosure of the trailer seal.
Figure 16:
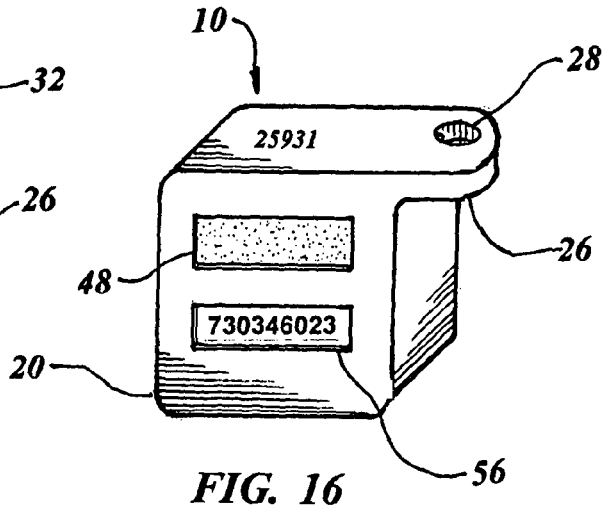
FIG. 16 is a partial isometric view of a second alternate embodiment of the enclosure of the trailer seal.

In the preferred embodiment the arm 26 also incorporates a slot 32 within its distal end for engaging the retained leg 34 of the padlock 24, thereby placing the seal 10 adjacent to the padlock, as depicted in FIG. 1. The slot 32 is sufficiently wide to receive the retained leg 34 of most padlocks 24 without binding or interference. The spacing between the aperture 28 and the slot 32 is governed by the size limitations of the padlock 24, such that the seal 10 may be universal in its application with almost any padlock 24. An acceptable alternate to the aim 26 extending laterally from the enclosure 20, the arm 26 may extend to the rear, as shown in FIG. 15, placing the seal 10 on the front of the padlock 24. A second alternate embodiment, shown in FIG. 16, omits the slot 32 entirely and simplifies the mounting arrangement while still providing the necessary attachment and security.

In order to retain the identity of the reusable electronic seal 10, the structural enclosure 20 includes a serial number permanently displayed in any prominent location, such as on the outwardly extending arm 26 illustrated in FIGS. 1-3, 15 and 16.

The structural enclosure 20 may be formed with a cast thermosetting resin, such as acrylic, styrene, polyester, epoxy, silicone, nylon etc. or injection molded with a thermoplastic resin, including ABS, acetyl, acrylic, cellulose, Nylon, polycarbonate, polyethylene, polypropylene, polystyrene, vinyl and the like with injection molding being preferred.

An electronic module 36 is integrated within the enclosure 20 which contains all of the solid state components required for functional operation. For convenience of connecting the components electrically, a printed circuit board 38 is utilized.

Figure 9:
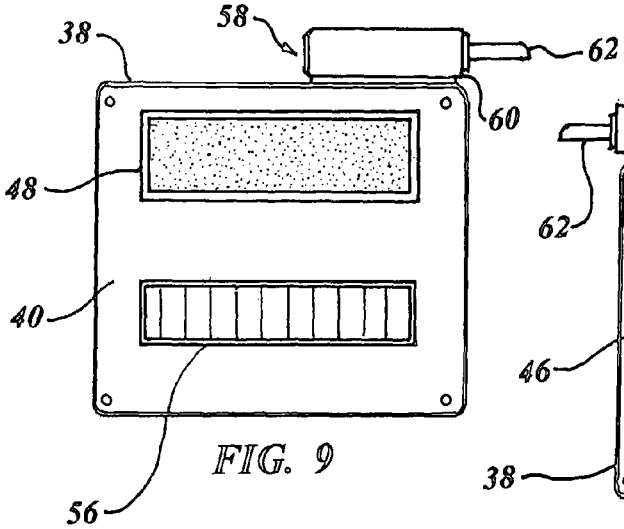
FIG. 9 is a partial isometric front view of the electronic module of the trailer seal with an electromechanical shackle engagement switch.
Figure 10:
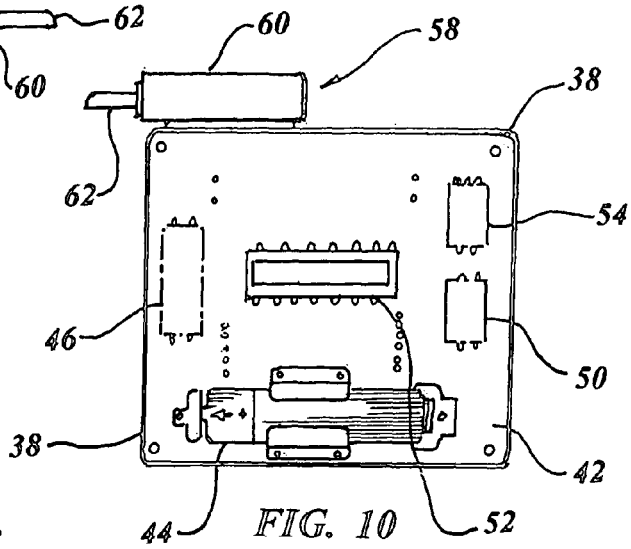
FIG. 10 is a partial isometric rear view of the electronic module of the trailer seal with an electromechanical shackle engagement switch.
Figure 11:
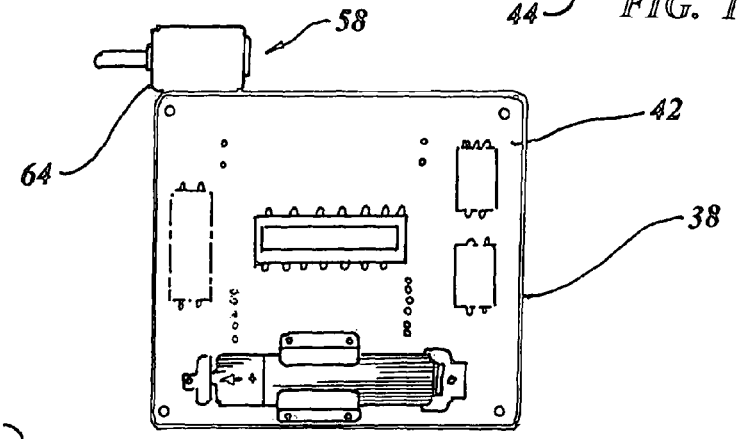
FIG. 11 is a partial isometric front view of the electronic module of the trailer seal with a magnetic shackle engagement switch.
Figure 12:
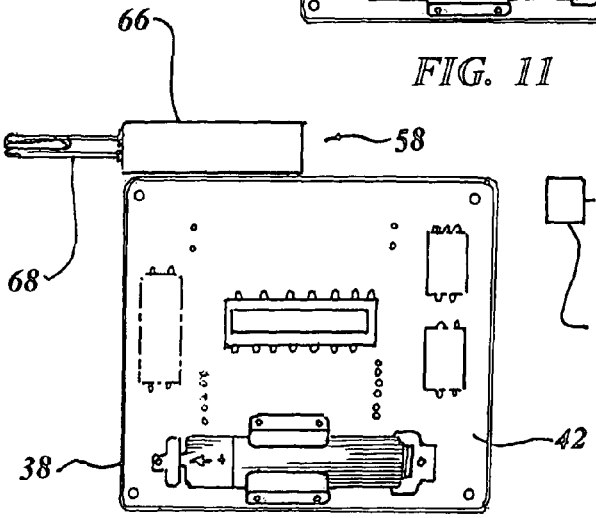
FIG. 12 is a partial isometric front view of the electronic module of the trailer seal with an electromagnetic wire loop shackle engagement switch.
Figure 13:
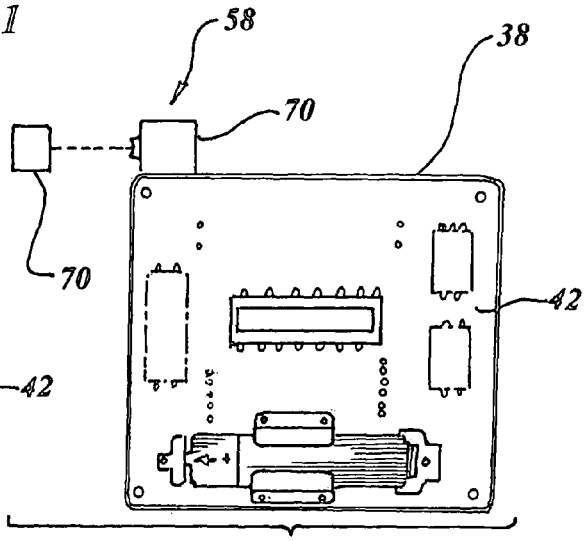
FIG. 13 is a partial isometric front view of the electronic module of the trailer seal with a photoelectric cell shackle engagement switch.

FIGS. 9-13 illustrate the printed circuit board 38 with the visual components on the front side 40 and the remainder of the components located on the rear side 42. The drawing FIGURES are simply for illustration purposes only, as many alternative circuits and combinations may be used for the interconnection and types of solid state elements required to accomplish the functions described and claimed. FIG. 9 illustrates the front side 40 of the printed circuit board 38, with FIGS. 10-13 depicting a representative view of the rear side 42.

A rechargeable battery 44 is attached to the rear side 42 of the printed circuit board 38 and is used as the main electrical power source for the electronics. There are many types and styles of rechargeable batteries 44 that could be used in this application including nickel cadmium type (Ni—CD), nickel metal Hydrate (Ni-MH) Lithium, Li-ion and N0-MEM etc.

A battery charging circuit 46 is in communication with the rechargeable battery 44 and a photovoltaic cell 48, commonly called a solar cell, is in communication with the battery charging circuit 46, providing a power source for recharging the battery 44. A voltage sensor 50 interfaces with the battery 44 indicating the existing voltage of the battery 44.

Figure 14:
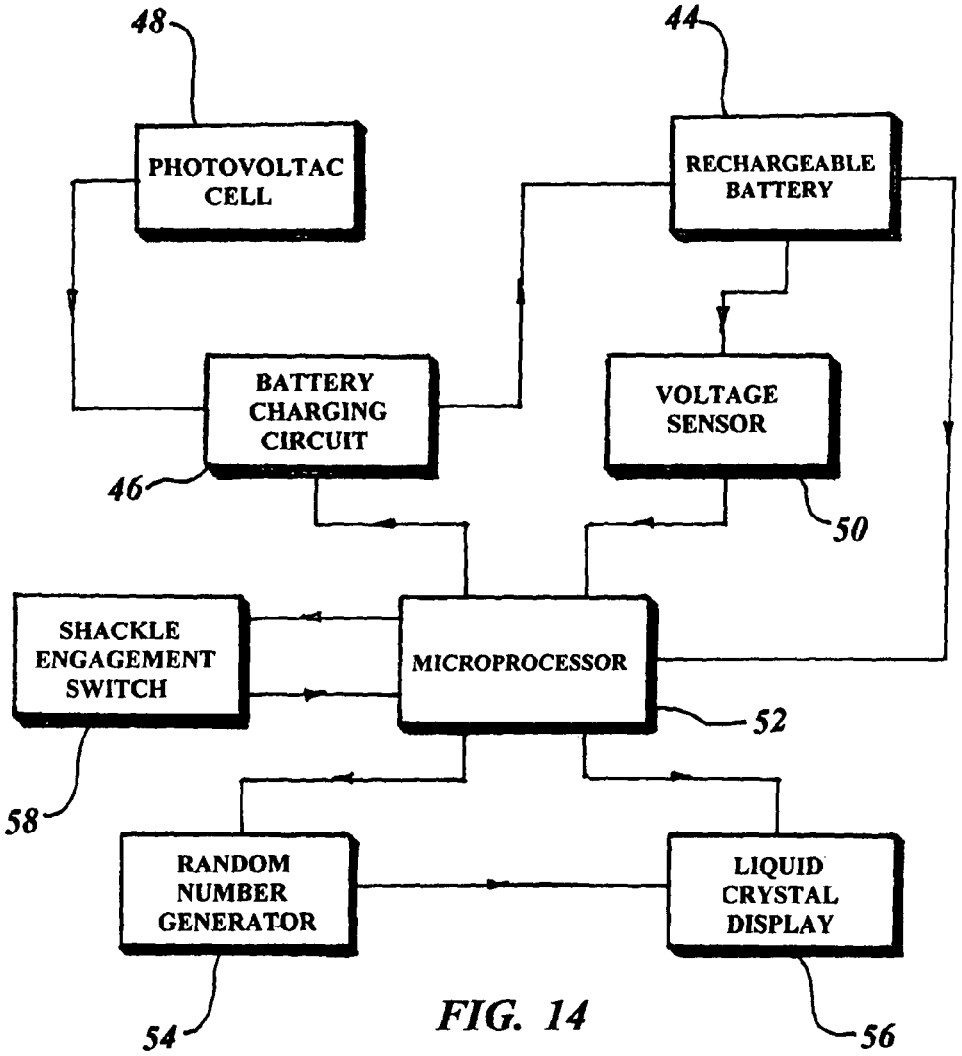
FIG. 14 is a block diagram of the electronics of the trailer seal.

A microprocessor 52 is used to control the complete function of the trailer seal 10 and is powered entirely by the battery 44. The microprocessor 52 may be any type and style well known in the art capable of being programmed with software. The microprocessor 52 receives a battery voltage signal from the voltage sensor 50 and, if low voltage is sensed, the microprocessor 52 sends a signal to the battery charging circuit 46 to recharge the battery 44, by connecting the power from the photovoltaic cell 48 directly to the battery 44 as depicted schematically in the block diagram of FIG. 14.

A random number generator 54 interfaces with the microprocessor 52 and is also is directly connected to a liquid crystal display 56. The random number generator 54 receives a signal from the microprocessor 52 and creates a random number which is then subsequently sent to the liquid crystal display 56.

A shackle engagement switch 58 is configured to contact the padlock shackle 22, and provide a completed circuit signal to the microprocessor 52. The shackle engagement switch 58 closes a circuit when the padlock 24 has been opened and stays closed until the padlock 24 is re-latched the shackle engagement switch 58 thereby permitting the microprocessor 52 to signal the random number generator 54 to send a new random number to the liquid crystal display 56.

The shackle engagement switch 58, as shown in FIGS. 9-13 may be an electromechanical switch 60 having an outwardly extending spring loaded plunger 62 interfacing with a padlock pivotal leg 30 such that when the pivotal leg 30 is locked into the padlock 24, the plunger 62 touches the pivotal leg 30 through a side opening in the shackle aperture 28. When the pivotal leg 30 is removed the plunger 62 extends within the shackle aperture 28 to an at rest position. When the plunger is extended the shackle engagement switch 58 sends a signal to the microprocessor 52 that the padlock 24 is opened until the padlock pivotal leg 30 is again inserted into the shackle aperture 28 compressing the plunger 62 sending a signal to the microprocessor 52 that the padlock 24 is engaged.

A second alternate embodiment of the shackle engagement switch 58 may be a magnetic switch 64 which closes a contact when the shackle pivotal leg 30 is locked into the padlock 24 and sends a signal to the microprocessor 52 that the padlock 24 is locked, when the padlock 24 is unlocked and the shackle pivotal leg 30 is removed from the switches magnet field, the signal to the microprocessor 52 is discontinued until the padlock pivotal leg 30 is again inserted into the shackle aperture 28 within the magnetic field sending a signal to the microprocessor 52 that the padlock 24 is engaged.

A third alternate embodiment of the shackle engagement switch 58 may be a magnetic field switch 66 having a wire loop 68 around the shackle aperture 28 creating an electromagnetic field when a current is introduced into the loop 68 which changes resistance when the metallic padlock shackle 22 is within the loop 68.

A fourth alternate embodiment of the shackle engagement switch 58 may be a photoelectric cell 70 that sends a signal to the microprocessor 52 when a pivotal leg 30 of the shackle is removed from the padlock 24 and continues the signal until the pivotal leg 30 is replaced in the padlock 24.

An optional feature may be incorporated in trailer seal 10 with the microprocessor 52 programmed to send a message to the liquid crystal display 56 to indicate a warning of low voltage from the battery 44 that the battery 44, photovoltaic cell 48 or battery charging circuit 46 is malfunctioning and the entire self contained seal 10 may need replacement While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A reusable electronic seal for a trailer which comprises:

a structural enclosure configured to attach onto a shackle of a padlock, wherein said structural enclosure further comprising an outwardly extending arm for interfacing with the padlock, and said structural outwardly extending arm further having a shackle aperture therethrough configured to receive a pivotal leg of the padlock shackle to lock the seal onto the padlock an electronic module integrated within the enclosure, said module comprising;

a rechargeable battery producing an electrical power source, a battery charging circuit in communication with said battery, a photovoltaic cell in communication with said battery charging circuit providing a power source for recharging the battery, a voltage sensor interfacing with said battery indicating battery voltage, a microprocessor programmed with software to receive a battery voltage signal from the voltage sensor and if low voltage is sensed by the microprocessor the microprocessor sends a signal to the battery charging circuit to recharge the battery, wherein said microprocessor receiving electrical power from said battery, a random number generator interfacing with said microprocessor, a liquid crystal display communicating with said random number generator, and a shackle engagement switch configured to engage the padlock shackle, applying a signal to said microprocessor such that when the padlock has been opened and re-latched the shackle engagement switch signals the microprocessor to signal the random number generator to send a new number to the liquid crystal display.

2. The reusable electronic seal for a trailer as recited in claim 1 wherein said structural enclosure is formed with a cast thermosetting resin selected from a group consisting of acrylic, styrene, polyester, epoxy, silicone and nylon.

3. The reusable electronic seal for a trailer as recited in claim 1 wherein said structural enclosure is injection molded with a thermoplastic resin selected from a group consisting of ABS, acetyl, acrylic, cellulose, Nylon, polycarbonate, polyethylene, polypropylene, polystyrene and vinyl.

4. The reusable electronic seal for a trailer as recited in claim 1 wherein said structural enclosure having a serial number permanently displayed thereon.

5. The reusable electronic seal for a trailer as recited in claim 1 wherein said electronic module further comprises a printed circuit board.

6. The reusable electronic seal for a trailer as recited in claim 1 wherein said battery further comprises a nickel cadmium type.

7. The reusable electronic seal for a trailer as recited in claim 1 wherein said microprocessor is programmed with software to permit a number originally shown on the liquid crystal display to remain after the padlock is opened and until the padlock is re-latched when a new random number is displayed.

8. The reusable electronic seal for a trailer as recited in claim 1 wherein said structural outwardly extending arm further having a shackle aperture therethrough configured to receive a pivotal leg of the padlock shackle to lock the seal onto the padlock, wherein said arm having a slot on a distal end for engaging a retained leg of the padlock for orienting the seal adjacent to the padlock.

9. The reusable electronic seal for a trailer as recited in claim 1 wherein said shackle engagement switch further comprises, an electromechanical switch having an outwardly extending spring loaded plunger interfacing with a padlock pivotal leg such that when the pivotal leg is locked into the padlock the plunger touches the pivotal leg through a side opening in the shackle aperture, and when the pivotal leg is removed the plunger extends within the shackle aperture to an at rest position sending a signal to the microprocessor that the padlock is opened until the padlock pivotal leg is again inserted into the shackle aperture compressing the plunger sending a signal to the microprocessor that the padlock is engaged.

10. The reusable electronic seal for a trailer as recited in claim 1 wherein said shackle engagement switch further comprises a magnetic switch which closes a contact when a shackle pivotal leg is locked into the padlock and sends a signal to the microprocessor that the padlock is locked, when the padlock is unlocked and the shackle pivotal leg is removed from the switches magnet field, the signal to the microprocessor is discontinued until the padlock pivotal leg is again inserted into the shackle aperture within the magnetic field sending a signal to the microprocessor that the padlock is engaged.

11. The reusable electronic seal for a trailer as recited in claim 1 wherein said shackle engagement switch further comprises a magnetic field switch having a wire looped around the shackle aperture creating an electromagnetic field when a current is introduced into the loop, which changes resistance when the metallic padlock shackle is within the loop, closing a contact when a pivotal leg of the shackle is locked into the padlock and sends a signal to the microprocessor that the padlock is locked, when the padlock is unlocked and the shackle pivotal leg is removed from the switches magnet field, the signal to the microprocessor is discontinued until the padlock pivotal leg is again inserted into the shackle aperture within the magnetic field sending a signal to the microprocessor that the padlock is engaged.

12. The reusable electronic seal for a trailer as recited in claim 1 wherein said shackle engagement switch further comprises a photoelectric cell the sends a signal the microprocessor when a pivotal leg of the shackle is removed from the padlock and continues the signal until the pivotal leg is replaced in the padlock.

13. The reusable electronic seal for a trailer as recited in claim 1 wherein said random number generator receives a power signal from the microprocessor creating a random number to send to the liquid crystal display.

14. The reusable electronic seal for a trailer as recited in claim 1 wherein said microprocessor is programmed to send a message to the liquid crystal display to indicate a warning of low voltage from the battery.

15. The reusable electronic seal for a trailer as recited in claim 1 wherein said structural enclosure is configured to attach to the padlock front surface.

16. The reusable electronic seal for a trailer as recited in claim 1 wherein said structural enclosure is configured to attach to a pivotal leg of the padlock shackle only.

* * * * *